US006294031B1

(12) United States Patent
Takeno et al.

(10) Patent No.: US 6,294,031 B1
(45) Date of Patent: Sep. 25, 2001

(54) PRODUCTION METHOD OF A HEAT-TREATED STEEL MEMBER

(75) Inventors: Hiroyuki Takeno, Hiratsuka; Masahiro Nakajima, Tokyo; Kiyokazu Niwa, Toyohashi; Go Morishima, Chigasaki; Daigo Sugiyama, Toyohashi, all of (JP)

(73) Assignee: Topy Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/148,707

(22) Filed: Sep. 4, 1998

(30) Foreign Application Priority Data

Sep. 5, 1997 (JP) ..... 9-240110
Jul. 29, 1998 (JP) ..... 10-214001

(51) Int. Cl.[7] ..... C21D 8/00
(52) U.S. Cl. ..... 148/654; 148/547
(58) Field of Search ..... 148/330, 662, 148/660, 545, 547, 654

(56) References Cited

FOREIGN PATENT DOCUMENTS

241120 * 10/1988 (JP) ..... 148/654
363266023 * 11/1988 (JP) ..... 148/330
0142023 * 6/1989 (JP) ..... 148/654
403267315 * 11/1991 (JP) ..... 148/654

OTHER PUBLICATIONS

English Abstract of Japanese Patent 055232, May 18, 1973.*
English Abstract of Japanese Patent 60243223, Dec. 3, 1985.*

* cited by examiner

*Primary Examiner*—Deborah Yee
(74) *Attorney, Agent, or Firm*—Pillsbury Winthrop LLP

(57) ABSTRACT

A production method of a heat-treated steel member includes the steps of: shaping a steel material of low-carbon boron steel containing about 0.05–0.30% carbon by weight into a predetermined configuration to bc a shaped material; and heat-treating the shaped material, said heat-treating, includes quench-hardening only.

5 Claims, 3 Drawing Sheets

PRODUCTION METHOD OF A HEAT-TREATED STEEL MEMBER

This application is based on Japanese Patent Applications HEI 9-240110 filed on Sep. 5, 1997 and HEI 10-214001 filed on Jul. 29, 1998, the content of which is incorporated into the present application by reference.

BACKGROUND OF THE INVENTION

1. Field of the Invention

The present invention relates to a production method of a heat-treated steel member.

2. Description of Related Art

Some steel members are used in an as rolled and not heat-treated state, but other steel members requiring a high wear resistance (hardness), tensile strength and toughness are heat-treated after rolling,. Such a steel member that is heat-treated and then used is called as a heat-treated member. Typical heat-treated members include a shoe, a link, a pin and a bushing used for an endless track mounted to construction vehicles such as a power shovel and a bulldozer, and a cutting edge of a blade used for a bulldozer and a vehicle with snow plough. Further, many other structural components used in various kinds of industrial machines are made from the heat-treated members.

As illustrated in FIG. 2, a conventional production method of a heat-treated member includes a shaping step 11 in which a steel material is shaped into a predetermined configuration to be a shaped material, and a heat treatment step 12 in which the shaped material is heat-treated. The heat treatment step 12 involves two steps of quench-hardening and tempering, which are typically both performed (Japanese Patent Publication No. HEI 3-219043).

The reason why the heat treatment step requires two steps, i.e., quench-hardening and tempering, is as follows:

Generally, with the heat-treated member, the characteristics of wear resistance (hardness), and tensile strength and toughness are incompatible characteristics with each other. More particularly, in a case where quench-hardening only is conducted, wear resistance (hardness) and tensile strength are greatly improved, while toughness is remarkably low. In the case where the heat treatment includes quench-hardening followed by tempering, although wear resistance (hardness) and tensile strength are slightly lowered, toughness is greatly improved so that necessary wear resistance (hardness), tensile strength and toughness are ensured. In other words, in a case where both quench-hardening and tempering are not conducted, the necessary wear resistance (hardness), tensile strength and toughness are not ensured.

However, the conventional production method has the following problems:

First, since the heat treatment requires two steps, i.e., quench-hardening and tempering, the number of production steps, production time and equipments are increased, resulting in an increase in the production cost.

Second, if either quench-hardening or tempering is simply removed from the heat treatment steps, any one of the necessary wear resistance (hardness), tensile strength and toughness is not ensured.

SUMMARY OF THE INVENTION

An object of the present invention is to provide a production method of a heat-treated member wherein the number of production steps, production time and equipments can be decreased compared with the conventional heat treatment, and the necessary wear resistance (hardness), tensile strength and toughness are also ensured.

The above-described object is achieved by the following present invention:

A production method of a heat-treated member includes the steps of: shaping a steel material of low-carbon boron steel containing about 0.05–0.30% carbon by weight into a predetermined configuration to be a shaped material; and heat-treating the shaped material, the heat-treating including quench-hardening only.

In the production method according to the present invention, a heat-treatment comprising the step of quench-hardening only is conducted on the steel material; a tempering step is removed, as compared with the conventional heat treatment involving two steps, i.e., quench-hardening and tempering. As a result, the number of production steps, and the production time corresponding to the removed tempering step are decreased. In addition, equipment for conducting tempering is not necessary. As a result, cost for producing the heat-treated member can be reduced.

In the production method according to the present invention, necessary wear resistance (hardness), tensile strength and toughness are ensured even without conducting the tempering step. The reason is as follows:

In the case of a medium-carbon (alloy) steel containing 0.30–0.50% carbon by weight, the carbon (alloy) steel has a medium-carbon martensite microstructure in a quench-hardened and not tempered state. The medium-carbon martensite microstructure has a high hardness and a high tensile strength. but has a low toughness. When tempering at a low temperature (below about 200° C.) is conducted on the quench-hardened material, the medium-carbon martensite is decomposed to a low-carbon martensite and a carbide. As a result, although the necessary hardness and tensile strength are slightly decreased, the toughness is improved, which allows the quench-hardened and tempered material to be used as a heat-treated member. On the other hand, in the case of a low-carbon (alloy) steel including 0.30)% or less carbon by weight, when tempering at a low temperature (below about 200° C.) is conducted subsequent to quench-hardening, the microstructure is of a low-carbon martensite microstructure only. As a result, the necessary hardness, tensile strength and toughness are ensured, which allows the quench-hardened and tempered material to be used as a heat-treated member.

With the low-carbon (alloy) steel, the microstructure was examined after quench-hardening and before tempering. It was found that the microstructure was of a low-carbon martensite microstructure only, which was the same microstructure as that obtained when tempering at a low temperature was conducted after quench-hardening. Further, it was also found that the hardness. tensile strength and toughness were substantially the same as those obtained when tempering, was conducted after quench-hardening. In the present invention, by using low-carbon (alloy) steel as a material, tempering at a low temperature is removed from the heat treatment process without substantially decreasing hardness, tensile strength and toughness.

The reason for selecting the carbon content of 0.05–0.30% by weight is that if the carbon content is less than 0.05% by weight, the predetermined hardness and tensile strength cannot be obtained due to the too small carbon content in the low-carbon martensite microstructure generated during quench-hardening, and that if the carbon content is greater than 0.30% by weight, the microstructure generated during quench-hardening is a medium-carbon martensite microstructure having a low toughness, which requires tempering after quench-hardening. In the range close to 0.30% carbon by weight, the microstructures obtained with the low-carbon (alloy) steel and with the medium-carbon (alloy) steel exist. In order to cause only the low-carbon martensite microstructure to be generated during quench-hardening, the carbon content is to be selected preferably 0.05–0.279% by weight, and more preferably, 0.20–0.26% by weight.

With the low-carbon steel of the present invention, 0.0001–0.0100% boron by weight is added to the low-carbon steel. One reason for the addition of boron is to ensure a hardenability and another reason is to ensure a necessary toughness in the high hardness range. With regard to the hardenability, there is a problem in that, with the low-carbon steel, it is difficult to harden the core portion of the heat-treated member. In order to improve the hardenability, 0.0001–0.0100% boron by weight is added to the low-carbon steel, and more preferably, 0.0005–0.0030% boron by weight is added thereto, thereby ensuring the necessary hardenability. Due to the addition of boron, the present invention can be applied not only to a heat-treated member in which quench-hardening is conducted to a surface portion only as in a high-frequency induction-hardening, but also to a heat-treated member in which the core portion also needs to be quench-hardened.

In a case where a heat-treated member is of a large size and it is difficult to obtain a necessary hardenability by adding boron only, other chemical elements (chemical components) such as manganese, chromium, molybdenum which elevate the hardenability may be added in addition to boron.

Another reason for the addition of boron is to ensure a necessary toughness in the range of a high hardness above about HRC (Rockwell Hardness) 40.

As described above, by using the low-carbon boron steel as the material. necessary hardness, strength and toughness can be ensured by conducting heat treatment of quench-hardening only without conducting tempering.

DETAILED DESCRIPTION OF THE DRAWINGS

The above and other objects, features, and advantages of the present invention will become more apparent and will be more readily appreciated from the following detailed description of the preferred embodiments of the present invention in conjunction with the accompanying drawings, in which.

DETAILED DESCRIPTION OF THE PREFERRED EMBODIMENTS

Figure 1:
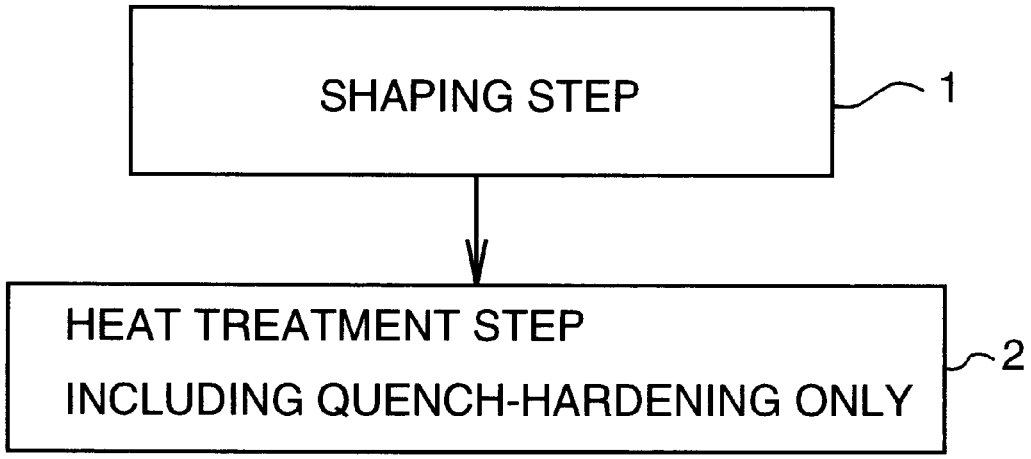
FIG. 1 is a block diagram illustrating production steps included in a method for producing a heat-treated member according, to an embodiment of the present invention.
Figure 2:
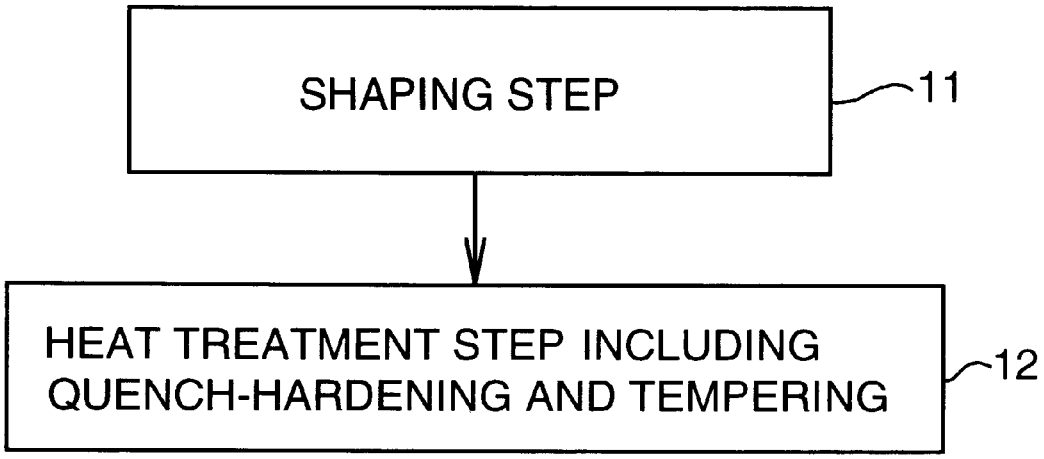
FIG. 2 (PRIOR ART)
FIG. 2 is a block diagram illustrating production steps included in a conventional production method of a heat-treated member.

As illustrated in FIG. 1, a production method of a heat-treated member according to an embodiment of the present invention includes step 1 of providing a steel material of low-carbon boron steel containing 0.05–0.30% carbon by weight and 0.001–0.0100% boron by weight and shaping the steel material into a predetermined configuration to be a shaped material, and step 2 of heat-treating the shaped material by conducting quench-hardening only. In the embodiment of the present invention, as shown in Table 1, since about 1.0% manganese by weight is added to the low-carbon boron steel in addition to boron, it can be called as a low-carbon manganese boron steel.

Preferably, the carbon content of the low-carbon boron steel of the material is 0.15–0.279% by weight. More preferably, the carbon content of the low-carbon boron steel of the material is 0.20–0.26% by weight. Further, the boron content of the low-carbon boron steel of the material is 0.0001–0.0100% by weight, and is preferably 0.0005–0.0030% by weight.

Table 1 shows the chemical composition of the steel material.

TABLE 1

| (weight %) | | | | | |
|---|---|---|---|---|---|
| C | Si | Mn | P | S | B |
| 0.15–0.279 | 0.15–0.35 | 0.80–1.10 | 0.025 or less | 0.015– or less | 0.0005–0.0030 |

Shaping the steel material to the shaped material can be conducted by using any one of rolling, forging and casting.

Figure 3:
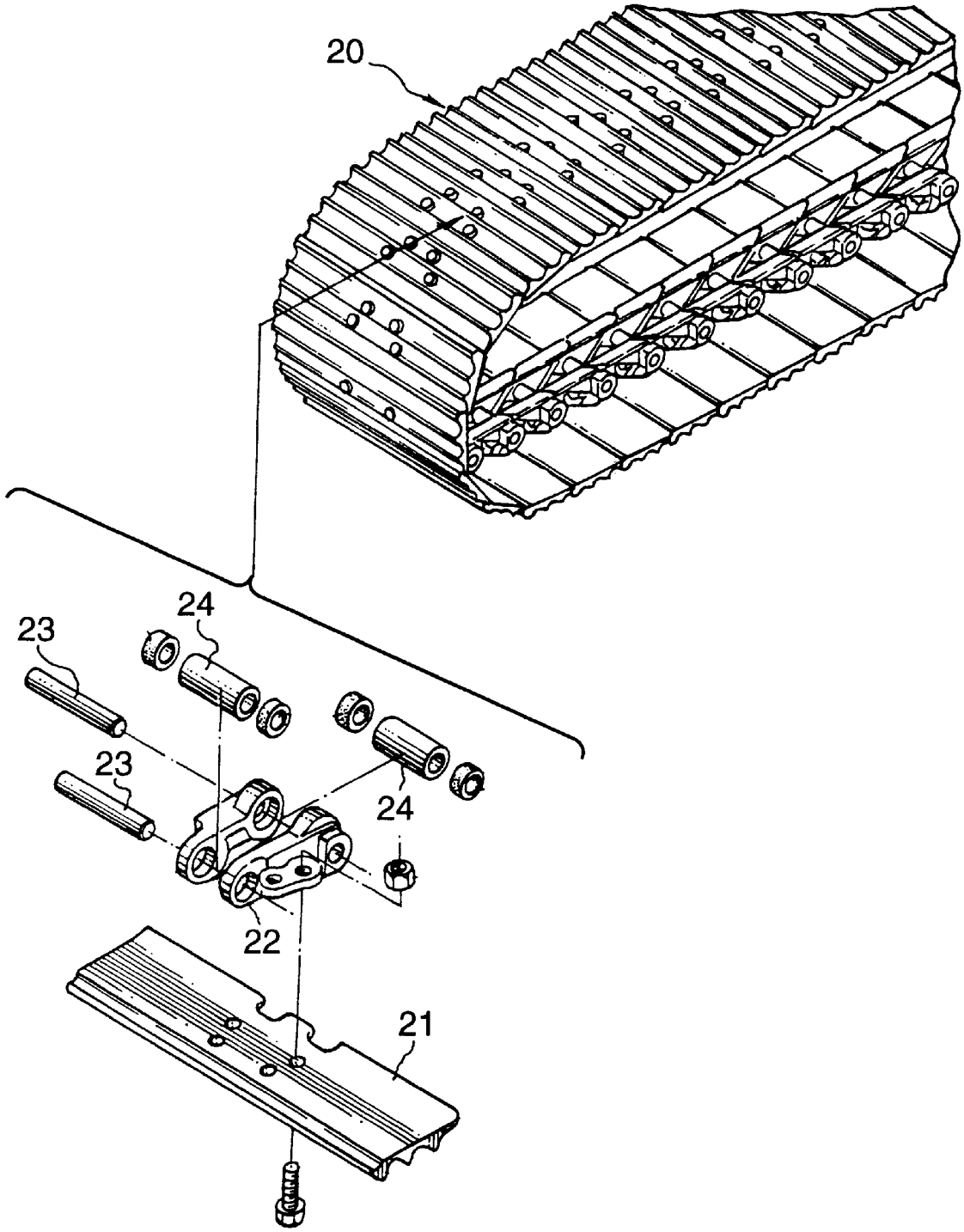
FIG. 3 is a perspective view of a portion of an endless track.
Figure 4:
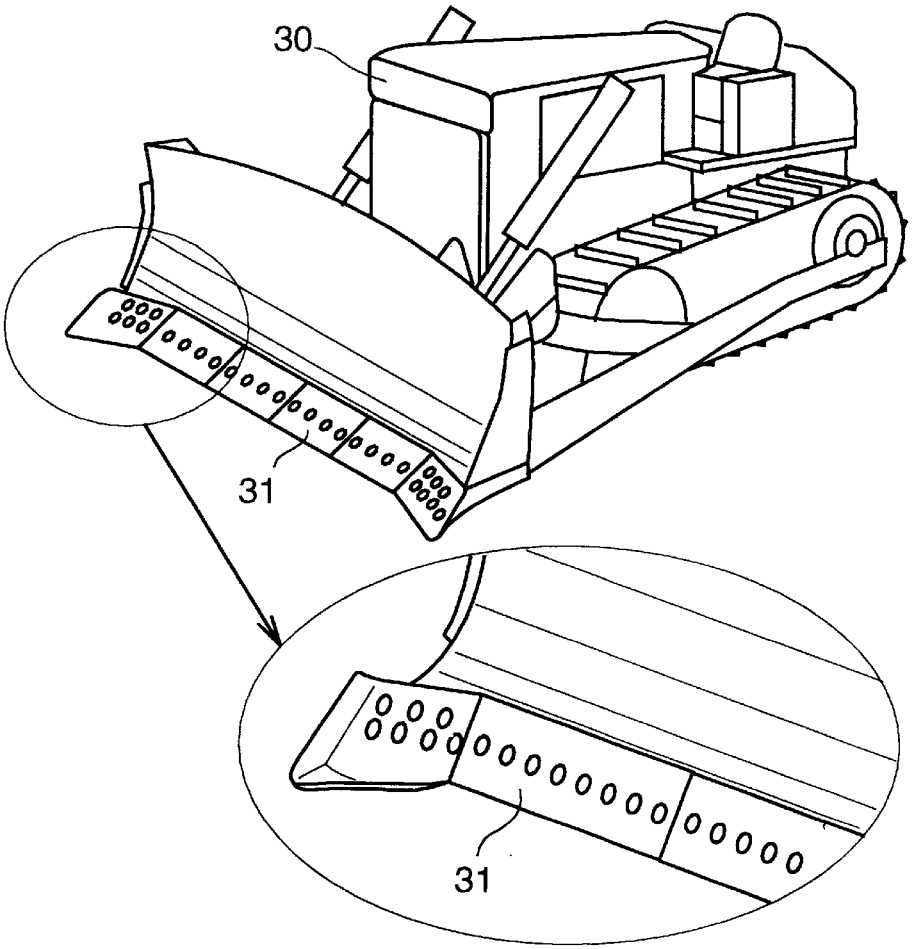
FIG. 4 is a perspective view of a construction vehicle.
Figure 5:
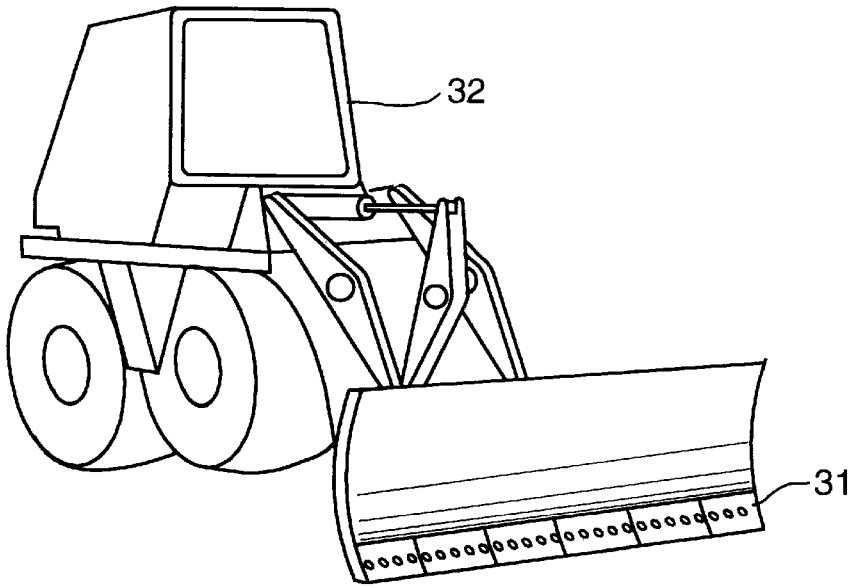
FIG. 5 is a perspective view of a vehicle with snow plough.

Examples of the heat-treated members include a shoe 21. a link 22, a pin 23 and a bushing 24 used for an endless track 20 mounted to construction vehicles such as a power shovel and bulldozer (see FIG. 3), and a cutting edge 31 of a blade used for construction vehicles 30 such as a bulldozer (see FIG. 4) and for a vehicle with snow plough 32 (see FIG. 5). Most mechanical structural members used in various kinds of industrial machines are heat-treated members. In the above, shaping means shaping the steel material into the predetermined configuration of the heat-treated member.

The condition that the heat treatment step 2 includes quench-hardening only means that the heat treatment step 2 does not include a tempering step (tempering at a low temperature or tempering at a high temperature). That is, the steel material which is quench-hardened and not tempered is used as a heat-treated member.

Quench-hardening conducted in the method according to the present invention is conducted in the same manner as conventional quench-hardening for a low-carbon (alloy) steel. More particularly, quench-hardening is conducted by heating the steel material to a temperature above $Ac_3$ transformation temperature (the temperature at which the ferrite and pearlite microstructure is transformed to austenite microstructure, and more particularly, about 900° C.) to change the microstructure to a uniform austenite structure, and then, immediately after heating, cooling the steel material rapidly to a temperature below about 200° C.

The metallic crystal structure at a completely quench-hardened portion close to a surface of the steel material conducted by quench-hardening only is a low-carbon martensite microstructure. As illustrated in Table 2, the completely quench-hardened portion has the, quality characteristics (mechanical properties) of a hardness of HRC 42–49, a tensile strength of 135–155 Kg/mm$^2$ and a toughness of 7–10 Kg m/cm$^2$ by Charpy impact value.

Taking as an example a shoe 21 used for an endless track 20 mounted to a construction vehicle such as a power shovel and a bulldozer and a cutting edge 31 of a blade used for a construction vehicle 30 such as a bulldozer and a vehicle with snow plough 32, tests were conducted for comparison between a product produced by the method according to the present invention and a product produced by the conventional method.

Table 2 shows the test results in which the comparison was made with the shoe 21 used for the endless track 20 of the construction vehicle.

Thc heat-treated member produced according to the conventional method in which the rolled material of low-carbon manganese boron steel was quench-hardened then tempered at a low temperature had a low-carbon martensite microstructure only, and, as shown in Table 2, had the hardness of HRC 42–49, the tensile strength of 135–155 Kg/mm$^2$, and the toughness of 7–10 Kg·m/cm$^2$ by Charpy impact value. As understood from the test results, the heat-treated member produced according to the method of the embodiment of the present invention had the same wear resistance (hardness), tensile strength and toughness as the heat-treated member produced according to the conventional method in which the rolled material of low-carbon manganese boron steel was quench-hardened and then tempered at a low temperature.

As a result, in the production method of the heat-treated member according to the embodiment of the present invention, tempering at a low temperature can be removed from the heat treatment step; thereby decreasing the number of production steps, production time and equipment necessary for conducting the removed tempering step, which results in a reduction in the production cost.

Table 2 shows the quality characteristics (mechanical properties), i.e., the wear resistance (hardness), the tensile strength and the toughness of the heat-treated member produced by the method according to the embodiment of the present invention. Table 2 also shows, for comparison, the wear resistance (hardness), the tensile strength and the toughness of the heat-treated member produced by the conventional method in which the material of low-carbon manganese boron steel was quench-hardened and then tempered, as well as those of the heat-treated member produced by the conventional method in which the material of medium-carbon manganese boron steel was quench-hardened and then tempered. Further, although the conventional heat treatment method includes the two steps, i.e., quench-hardening and tempering, in order to compare the heat treatment by the method according to the embodiment of the present invention including the quench-hardening step only with the conventional heat treatment method including the two steps, the wear resistance (hardness), the tensile strength and the toughness of the steel material of medium-carbon which was quench-hardened only and was not tempered were examined. The test results are shown in Table 2. It will be understood from the test results that the product using medium-carbon steel as a material and heat-treated according to the heat treatment method including the quench-hardening step only has a remarkably low toughness and cannot be used as a heat-treated member.

TABLE 2

| | | | Quality Characteristics | | |
|---|---|---|---|---|---|
| | Material | Production Process | Wear Resistance: Hardness (HRC) | Strength: Tensile Strength (kg/mm$^2$) | Toughness: Charpy Impact Value (Kg · m/cm$^2$) |
| Conventional Products | Medium-Carbon Manganese Steel | Rolling→Quench-Hardening | 50–55 | 160–175 | 1–3 |
| | | Rolling→Quench-Hardening→Tempering (at high temp.) | 37–43 | 120–135 | 3–8 |
| | Medium-Carbon Manganese Boron Steel | Rolling→Quench-Hardening | 50–55 | 160–175 | 2–5 |
| | | Rolling→Quench-Hardening→Tempering (at low temp.) | 45–51 | 145–160 | 4–8 |

TABLE 2-continued

| | Material | Production Process | Quality Characteristics: Wear Resistance: Hardness (HRC) | Strength: Tensile Strength ($kg/mm^2$) | Toughness: Charpy Impact Value ($Kg \cdot m/cm^2$) |
|---|---|---|---|---|---|
| | Low-Carbon Manganese Boron Steel | Rolling→Quench-Hardening→Tempering (at low temp.) | 42–49 | 135–155 | 7–10 |
| The Present Invention | | Rolling→Quench-Hardening | 42–49 | 135–155 | 7–10 |

Table 3 shows the test results in which the quality characteristics of the product produced according to the embodiment of the present invention and the product produced according to the conventional method were examined and compared taking as an example the cutting edge 31 of the construction vehicle 30 and the cutting edge 31 of the vehicle with snow plough 32.

Second, even though tempering is removed in the heat treatment, since the low-carbon boron steel is used as a material, the heat-treated member has a wear resistance (hardness), tensile strength and toughness equivalent to those of the heat-treated member heat-treated according to the conventional method which includes quench-hardening and tempering. Further, since the material contains boron, a good hardenability is ensured.

TABLE 3

| | Material | Production Process | Quality Characteristics: Wear Resistance: Hardness (HRC) | Strength: Tensile Strength ($Kg/mm^2$) | Toughness: Charpy Impact Value ($Kg \cdot m/cm^2$) |
|---|---|---|---|---|---|
| Conventional Products | Medium-Carbon Manganese Steel | Rolling→Quench-Hardening→Tempering (at low temp.) | 45–50 | 135–155 | 3–5 |
| The Present Invention | Low-Carbon Manganese Boron Steel | Rolling→Quench-Hardening | 42–49 | 135–155 | 7–9 |

As illustrated in Table 3, the quality characteristics of the heat-treated member produced by the method according to the embodiment of the present invention are equal to or higher than those of the product produced by the conventional method. In particular, the heat-treated member produced by the method according to the present invention has the same hardness and tensile strength as and a higher toughness than the product produced by the conventional method, even though quench-hardening only was conducted in the method of the present invention.

According to the present invention, the following technical advantages are obtained:

First, since the tempering step is removed from the heat treatment process, the number of production steps, production time and equipment can be reduced, resulting in a decrease in the production cost.

Although the present invention has been described with reference to specific exemplary embodiments, it will be appreciated in the art that various modifications and alterations can be made to the particular embodiments shown, without materially departing from the novel teachings and advantages of the present invention. Accordingly, it is to be understood that all such modifications and alterations are included within the spirit and scope of the present invention as defined by the following claims.

What is claimed is:

1. A method of producing a heat-treated steel member selected from any one of a shoe, a bushing, a link, and a pin used for an endless track mounted to a construction vehicle, and a cutting edge of a blade used for a construction vehicle and a vehicle with a snow plow, said method comprising:

providing a steel member of low-carbon boron steel containing about 0.20–0.30% carbon by weight;

shaping said steel material to form a shaped material; and quench-hardening said shaped material to form a low-carbon martensite microstructure close to a surface of said shaped material with a hardness of HRC 45 to 49, a tensile strength of 144 to 155 $Kg/mm^2$, and a toughness of 7 to 10 $Kg \cdot m/cm^2$ Charpy impact value;

said quench-hardening including heating an entire thickness of said shaped material to above an $Ac_3$ transformation temperature and then rapidly cooling said heated shaped material to below about 200° C. without tempering said shaped material subsequent to said quench-hardening.

2. A method according to claim 1, wherein the low-carbon boron steel contains 0.20–0.26% carbon by weight.

3. A method according to claim 1, wherein the low-carbon boron steel contains about 0.0001–0.0100% boron by weight.

4. A method according to claim 1, wherein the low-carbon boron steel contains 0.0005–0.0030% boron by weight.

5. A method according to claim 1, wherein the low-carbon boron steel contains about 0.80–1.10% manganese by weight.

* * * * *